US012077349B2

(12) United States Patent
Holmes et al.

(10) Patent No.: US 12,077,349 B2
(45) Date of Patent: Sep. 3, 2024

(54) CLOSURE

(71) Applicant: OBRIST CLOSURES SWITZERLAND GMBH, Reinach (CH)

(72) Inventors: Daniel Holmes, Flitwick (GB); Darren Garrett, Flitwick (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 269 days.

(21) Appl. No.: 17/784,410

(22) PCT Filed: Dec. 11, 2020

(86) PCT No.: PCT/EP2020/085862
§ 371 (c)(1),
(2) Date: Jun. 10, 2022

(87) PCT Pub. No.: WO2021/116468
PCT Pub. Date: Jun. 17, 2021

(65) Prior Publication Data

US 2023/0017736 A1 Jan. 19, 2023

(30) Foreign Application Priority Data

Dec. 12, 2019 (GB) ..... 1918317

(51) Int. Cl.
*B65D 47/08* (2006.01)
*B65D 55/02* (2006.01)
*B65D 55/16* (2006.01)

(52) U.S. Cl.
CPC ..... *B65D 47/0838* (2013.01); *B65D 55/024* (2013.01); *B65D 55/16* (2013.01); *B65D 2401/15* (2020.05)

(58) Field of Classification Search
CPC .. B65D 47/0838; B65D 55/024; B65D 55/16; B65D 2401/15; B65D 41/3447; B65D 47/0804
See application file for complete search history.

(56) References Cited

U.S. PATENT DOCUMENTS 6,269,986 B1 * 8/2001 Gross ..... B65D 47/0804 222/153.06
8,413,832 B2 * 4/2013 Mazurkiewicz ..... B65D 55/024 215/253

(Continued)

FOREIGN PATENT DOCUMENTS

CA 3059507 A1 * 10/2018 ..... B65D 41/32
WO WO-2009141700 A1 * 11/2009 ..... B65D 47/0804

(Continued)

OTHER PUBLICATIONS

International Search Report and Written Opinion for PCT/EP2020/085862 dated Mar. 19, 2021.

*Primary Examiner* — Bob Zadeh
(74) *Attorney, Agent, or Firm* — Barnes & Thornburg LLP

(57) ABSTRACT

A single-piece flip-top dispensing closure (10) is provided. The closure comprises a base (15) and a lid (20) joined by a hinge (25). The base is attachable to a container neck and includes an integral spout (45). A tamper-evident member is frangibly connected to the lid. The tamper-evident member includes a hook (85). The base is provided with a raised crossbar (550) under which the hook engages with the closure in an initially closed condition. When the lid is initially opened the interaction between the crossbar and the hook causes the tamper-evident member to release from the lid.

16 Claims, 16 Drawing Sheets

(56) References Cited

U.S. PATENT DOCUMENTS

Figure 2:
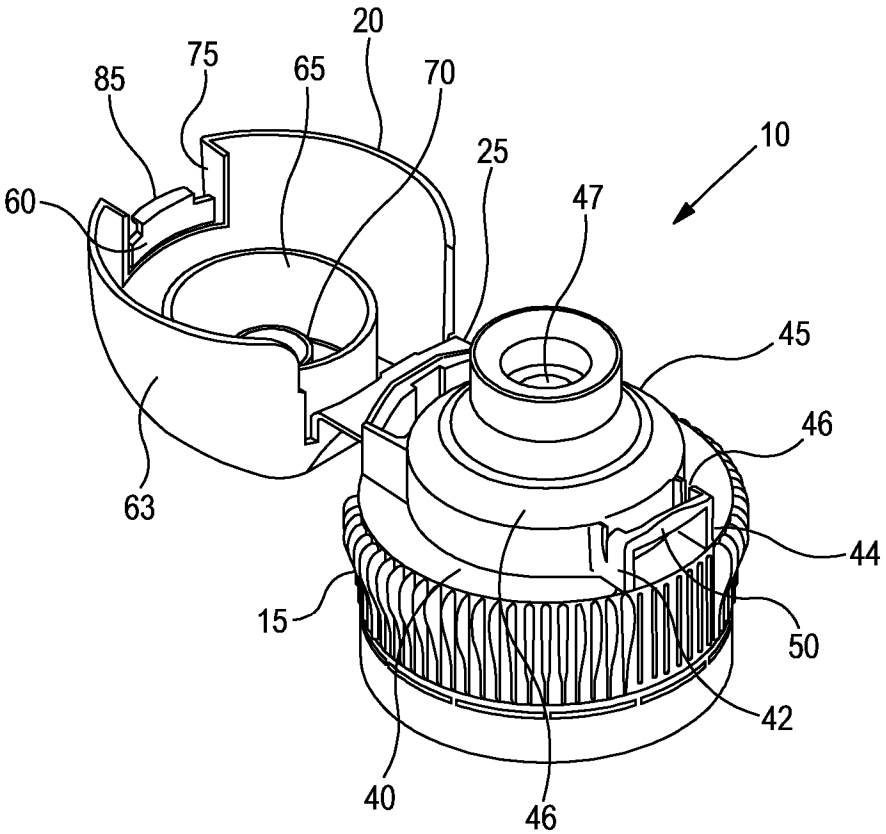

| | | | | |
|---|---|---|---|---|
| 2006/0043052 | A1* | 3/2006 | Lin | B65D 47/0838 215/253 |
| 2011/0056982 | A1* | 3/2011 | Swanick | B65D 51/222 222/83 |
| 2016/0016703 | A1* | 1/2016 | Mühlemann | B65D 41/06 222/566 |
| 2019/0344944 | A1 | 11/2019 | Maguire | |
| 2023/0017736 | A1* | 1/2023 | Holmes | B65D 47/0838 |

FOREIGN PATENT DOCUMENTS

| | | | | |
|---|---|---|---|---|
| WO | 2018069153 | | 4/2018 | |
| WO | WO-2018069153 | A1 * | 4/2018 | B65D 47/08 |
| WO | 2019207119 | | 10/2019 | |

* cited by examiner

CLOSURE

CROSS REFERENCE TO RELATED APPLICATIONS

This application is a U.S. national stage application under 35 U.S.C. § 371(b) of International Application No. PCT/EP2020/085862 filed Dec. 11, 2020, which claims priority to the United Kingdom Patent Application No. GB1918317.7 filed on Dec. 12, 2019, the disclosures of both of which are hereby expressly incorporated by reference in their entirety.

The present invention relates generally to a closure and particularly, although not exclusively, to flip-top dispensing closures and sports closure.

Some aspects of the present invention relate generally to a beverage closure for a container, for example a beverage closure which can provide some indication that the closure has been opened at least once.

It is known to provide container closures with tamper-evident drop bands which are released from the open end of a closure side wall upon first opening. Although drop bands provide some indication that the closure has been opened, because they are physically separated there is no clear indication of opening on the remaining part of the closure. It is also known to provide tear-off bands which are removed from a closure body upon first opening. However, the tear-off bands present a litter problem and a potential choking hazard because they are generally small tabs which are separated from the closure body.

In some aspects and embodiments the present invention relates to closure with a tamper-evident system for ensuring that a tamper-evidencing event is shown clearly; that there is a strong visual difference between the initial, unopened condition and the condition after tamper-evidencing has been activated.

An aspect of the present invention provides a single-piece flip-top dispensing closure, the closure comprises a base and a lid joined by a hinge, the base is attachable to a container neck and includes an integral spout, a tamper-evident member is frangibly connected to the lid, the tamper-evident member includes a hook, the base is provided with a raised crossbar under which the hook engages with the closure in an initially closed condition, in which when the lid is initially opened the interaction between the crossbar and the hook causes the tamper-evident member to release from the lid.

A further aspect provides a dispensing closure comprising a base and a lid joined by a hinge, a tamper-evident member is frangibly connected to the lid, the tamper-evident member includes a hook, catch or the like, the base is provided with a crossbar under which the hook, catch or the like engages with the closure in an initially closed condition, in which when the lid is initially opened the interaction between the crossbar and the hook causes the tamper-evident member to release from the lid.

A further aspect provides a dispensing closure comprising a base and a lid, a tamper-evident member is frangibly connected to the lid, the tamper-evident member includes catch means, the base is provided with a retainer which engages the catch means with the closure in an initially closed condition, in which when the lid is initially opened the interaction between the catch means and the retainer causes the tamper-evident member to release from the lid.

In some embodiments, following release the tamper-evident member is retained on or by the base.

In some embodiments, following release the tamper-evident member is visible beneath the crossbar.

The tamper-evident member and the crossbar may be generally opposite the hinge.

The tamper-evident member may be connected to the lid by a lateral frangible bridge at either side thereof. In some embodiments three frangible bridges are provided: two lateral bridges; and a superior medial bridge. The member may be provided in a cut-out, window or the like formed in the lid (for example at or towards the front of the lid).

The crossbar may be supported by lateral support members.

Lateral support member may be formed integrally with the spout.

The support members may, for example, upstand from a top deck.

In some embodiments each lateral support member includes a groove in which lateral frangible bridges of the tamper-evident member sit in the initially closed position. This prevents the bridges from breaking when the lid is initially closed onto the base.

The tamper-evident member may be formed as a tab or the like. It may be generally rectangular, for example.

The tamper-evident member hook may, for example, be formed as an inferior hook on the member.

The closure may have a double hinge arrangement.

The base may include a tamper-evident band, for example formed at a free end of a base sidewall.

The band may, for example, be formed as a tether. As a result the band may be partially (but not completely) released from the base. The band is non-releasably engaged onto a container so that it forms a tether to retain the closure.

The base may be provided with screw thread formations for engaging cooperating formations on a container neck.

The base may be provided with a snap bead for non-removably engaging a container neck.

The closure may be formed in an open position, for example with the lid moulded (for example injection moulded from a plastics material such as HDPE) in an open position. The lid must then be closed onto the base for a first time without causing release of the tamper-evident member. In addition, it is important to ensure that the member hook is adequately engaged under the crossbar so that it is reliably released upon first opening of the lid by a user.

In some embodiments features are provided to ensure proper engagement of the hook under the crossbar. In some embodiments features are configured to prevent and/or limit and/or control deformation of the tab during first closing. In other embodiments the features are configured to prevent and/or limit and/or control the tab from moving e.g. caused by hinging or stretching of the frangible bridges (i.e. the tab itself may not be deformed but it could move relative to the lid). In some embodiments the features act to prevent and/or limit and/or control movement of the tab (howsoever caused) relating to the crossbar that would tend to prevent proper engagement of the hook thereunder caused by deflection of the tab (e.g. deformation and/or hinging/stretching) when the lid is first closed onto the base and the hook must pass over the crossbar.

Closures formed in accordance with the present invention may comprise means for resisting and/or causing deflection and/or deformation of the tamper-evident member upon first closing of the lid to move the closure into the initially closed condition. This can be used, for example, to counter deflection of the tab as the hook passes under the crossbar and/or to push the tab forwards during and/or after the hook has passed under the crossbar so that the hook engages under the crossbar after it deflects to allow it to pass when the lid is closed.

In some embodiments one or more axial ribs are provided. For example a single axial rib may project radially from a dispensing spout. The axial rib may provide an inclined bearing surface along which the tamper-evident member slides when the lid is initially closed. By being inclined the member is progressively pushed forwards (in the opposite direction to the movement caused by the hook passing over the crossbar).

In some embodiments horizontal flap is at or close to be generally axially on a level with the underside of the crossbar.

In some embodiments the flap is resilient and deflects as the member slides over it.

In some embodiments both a vertical and a horizontal flap, rib or the like may be provided, for example, in a generally T-shape configuration.

In some embodiments the axial rib and/or the horizontal flap are axially spaced from the top deck of the base.

A further aspect provides a sportscap comprising a base and a lid joined by a hinge, the base is attachable to a container neck, the base includes a top deck and a depending side skirt, the base includes a dispensing spout, the lid includes a frontal cut-out in which a tamper-evident member is frangibly connected, the tamper-evident member includes a hook, the base is provided with a crossbar which is raised from the top deck and under which the hook engages with the closure in an initially closed condition, in which when the lid is initially opened the interaction between the crossbar and the hook causes the tamper-evident member to release from the lid.

A further aspect provides an aseptic closure for a ready-to-drink fruit juice container, comprising a closure as claimed in any preceding claim and subjected to a sterilisation process.

In some embodiments the closure is adapted to be sterilised, for example by a dry aseptic technique. An aseptic closure allows it to form part of a sterile filling line in use, which means that preservatives do not have to be used with fruit juices and the like.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, with reference to the accompanying drawings.

All orientational terms, such as upper, lower, radially and axially, are used in relation to the drawings and should not be interpreted as limiting on the invention or its connection to a closure.

Example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the invention is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein is not intended to limit the scope. The articles "a," "an," and "the" are singular in that they have a single referent; however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Figure 1:
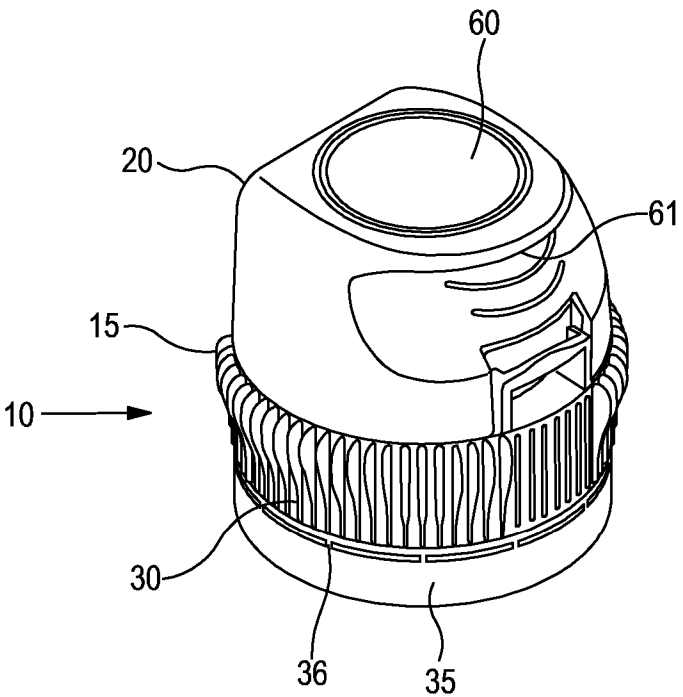
Figure 4:
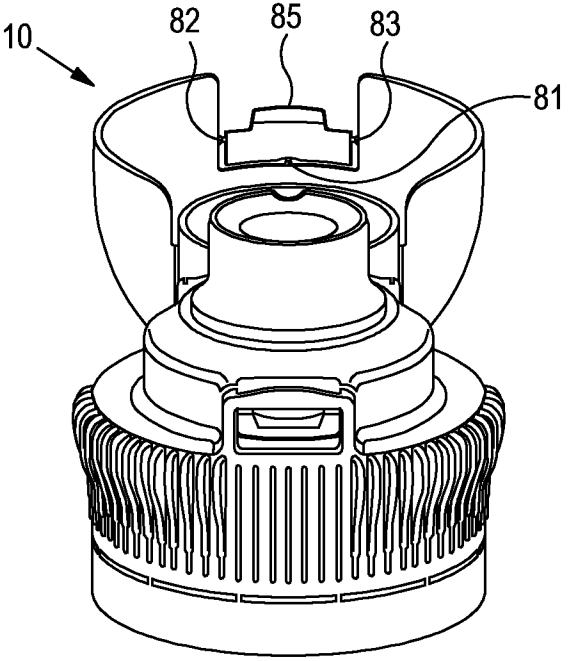
Figure 3:
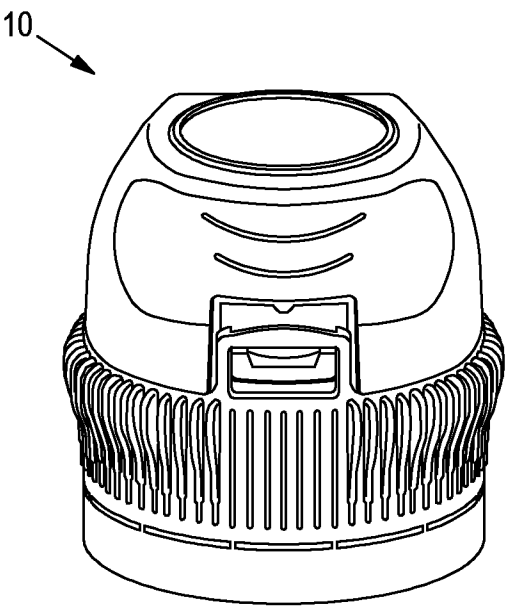
Figure 6:
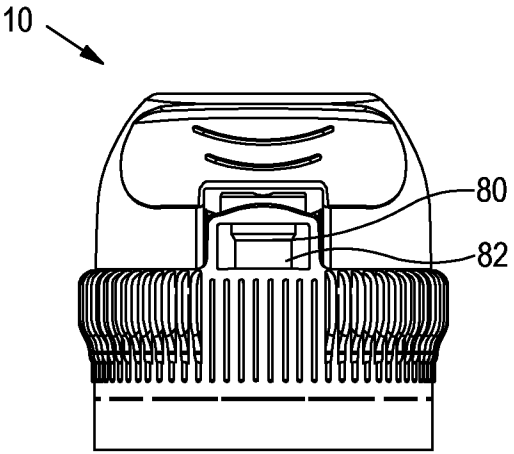
Figure 5:
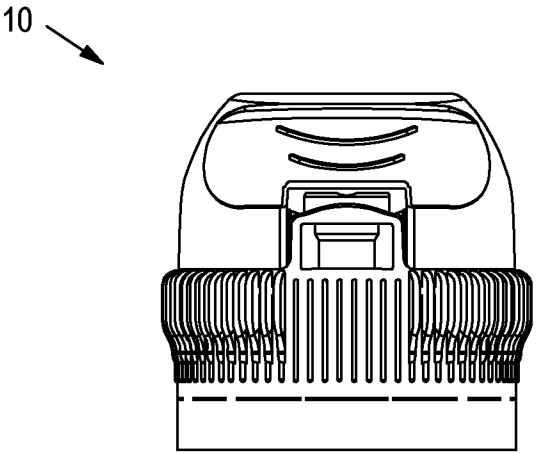

FIGS. 1 to 6 shows a closure generally indicated 10. FIGS. 1, 3 and 5 show the closure is an initially closed (unopened) condition. FIGS. 2 and 4 show the closure in an as-moulded (unclosed) condition before a lid is initially closed. FIG. 6 shows the closure following initial opening.

The closure 10 comprises a base 15 and a lid 20 joined by a hinge 25.

The base 15 comprises a generally cylindrical side skirt 30 having at one end a tamper-evident drop band 35 defined by frangible bridges 36.

In this embodiment the interior of the skirt is provided with screw thread formations for engaging corresponding formations on a container neck. The interior of the drop band is provided with an annular bead for engaging under a retention bead on the neck.

This ensures that the band is separated from the skirt in the event the closure is removed from the neck.

At the other end of the skirt 30 an annular top deck 40 extends radially inwards.

A drinking spout 45 extends from the top deck 40. The spout 45 is generally frusto-conical, and includes an intermediate ledge 46.

The end of the spout opposite the top deck is open, and terminates with a central orifice 47.

Generally opposite the hinge a pair of lateral, spaced supports 42, 44 upstand from the top deck 40 and extend from the periphery of the top deck back to the spout. Each of the supports 42, 44 has a U-shape groove/slot 43, 46.

A raised crossbar 50 extends across between the supports, radially outwards of the slots 43, 46. In some ways this therefore resembles a "goal", with lateral posts and a crossbar, creating a gap/window, The lid 20 includes a top plate 60 having a peak 61 on one side (opposite the hinge) for helping to lift the lid in use.

An exterior wall 63 depends from the top plate 60. In addition a first annular sealing wall 65 depends from the top plate 60 and engages the spout. A second (shorter) annular sealing wall 70 depends from the top plate and sealingly engages in the spout orifice 47.

Because, in this embodiment, the spout is formed integrally with the base the closure can be sterilised using a sterilising vapour applied from below i.e. up into the spout.

The front of the lid includes a cut-out section 75 in the wall 63. Within the cut-out section 75 a tamper-evident tab 80 is frangibly connected. In this embodiment the tab 80 is connected by a central bridge 81 and two lateral bridges 82, 83.

The tab 80 also includes a hook 85 at a lower edge.

The hook 85 can pass under the crossbar 50 when the lid is moved from the as-moulded condition to the initially closed condition. Thereafter, when the lid is lifted for the first time the crossbar prevents the hook, and thereby the tab, from lifting with the rest of the lid; accordingly when the lid is lifted the tab breaks away from the lid and falls down onto the top deck (FIG. 6). This provides visual evidence that the lid has been opened.

Figure 10:
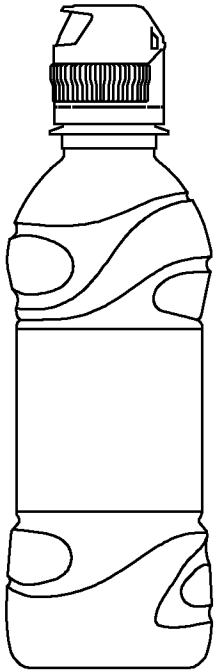
Figure 9:
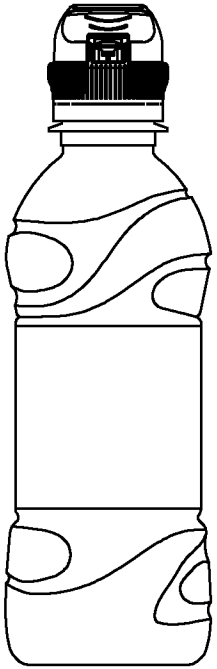
Figure 8:
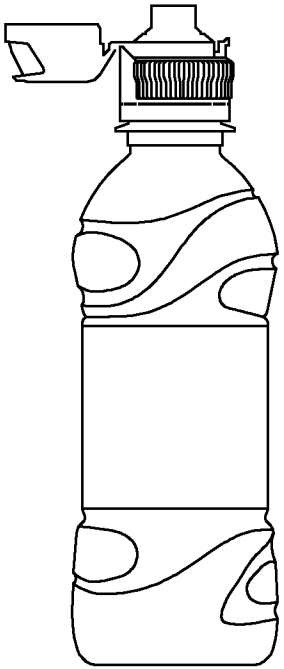
Figure 7:
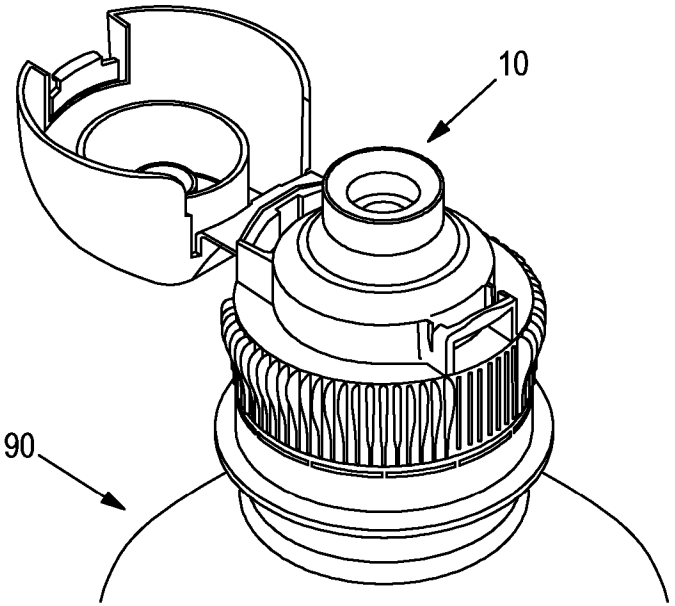

FIGS. 7 and 8 show the closure 10 attached to a container 90 and shown in an as-moulded condition. FIGS. 9 and 10 show the closure in an initially closed condition.

Figure 11:
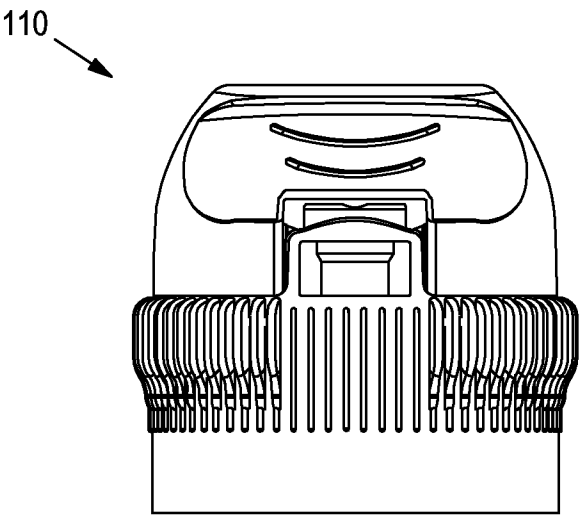

FIG. 11 shows a closure 110 formed according to a further embodiment. The closure is similar to the closure 10 except that there is no slitting of the skirt; accordingly there is no tamper-evident band. This embodiment is intended to be non-removably attachable to a container neck (e.g. with a snap bead), whereas the closure 10 can be removed by unscrewing, in which case the band 35 would be separated from the skirt 30.

Figure 12:
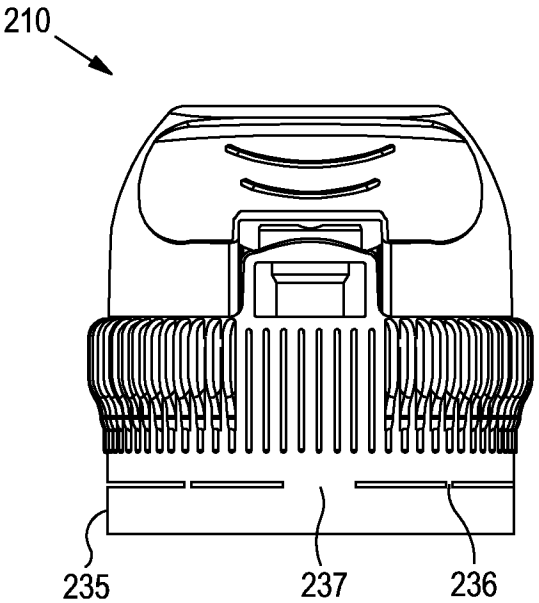
Figure 14:
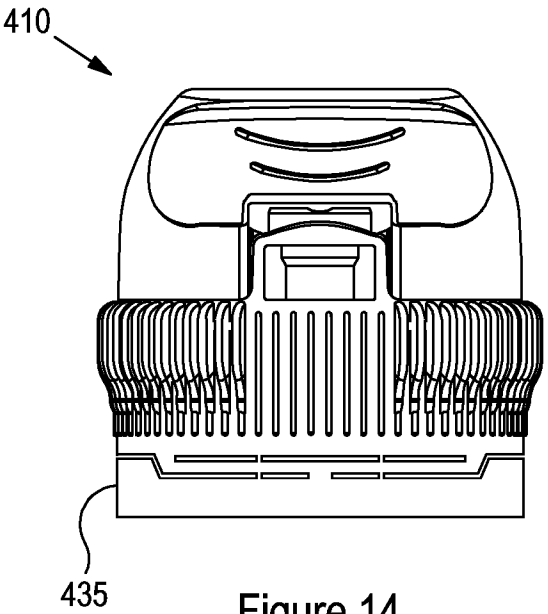
Figure 13:
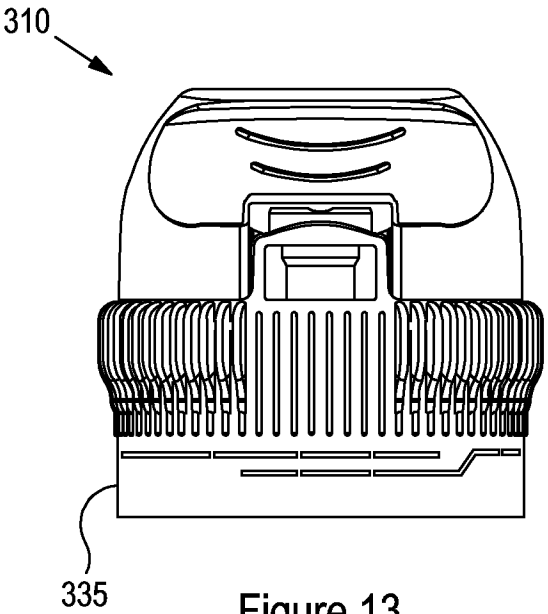

FIGS. 12 to 14 show closures 210, 310, 410 formed according to further "tethered" embodiments.

The closure has a band 235 connected to a skirt 230 by a plurality of frangible bridges 236 and a single non-frangible bridge 237. The interior of the band is provided with an annular bead for engaging under a retention bead on a container neck. This ensures that the band remains on the neck even if the skirt is unscrewed. The non-frangible bridge means that the band tethers the closure to the container.

The closure 310 has a band 335 including a slitting pattern that results in a "lasso" tether.

The closure 410 has a band 435 including a slitting pattern that results in a hinging tether.

FIGS. 15 to 23 show a closure 510 formed according to a further embodiment.

The closure 510 is similar to the closures 10, 110, 210, 310. In this embodiment features are provided to ensure proper engagement of the hook under the crossbar.

Figure 15:
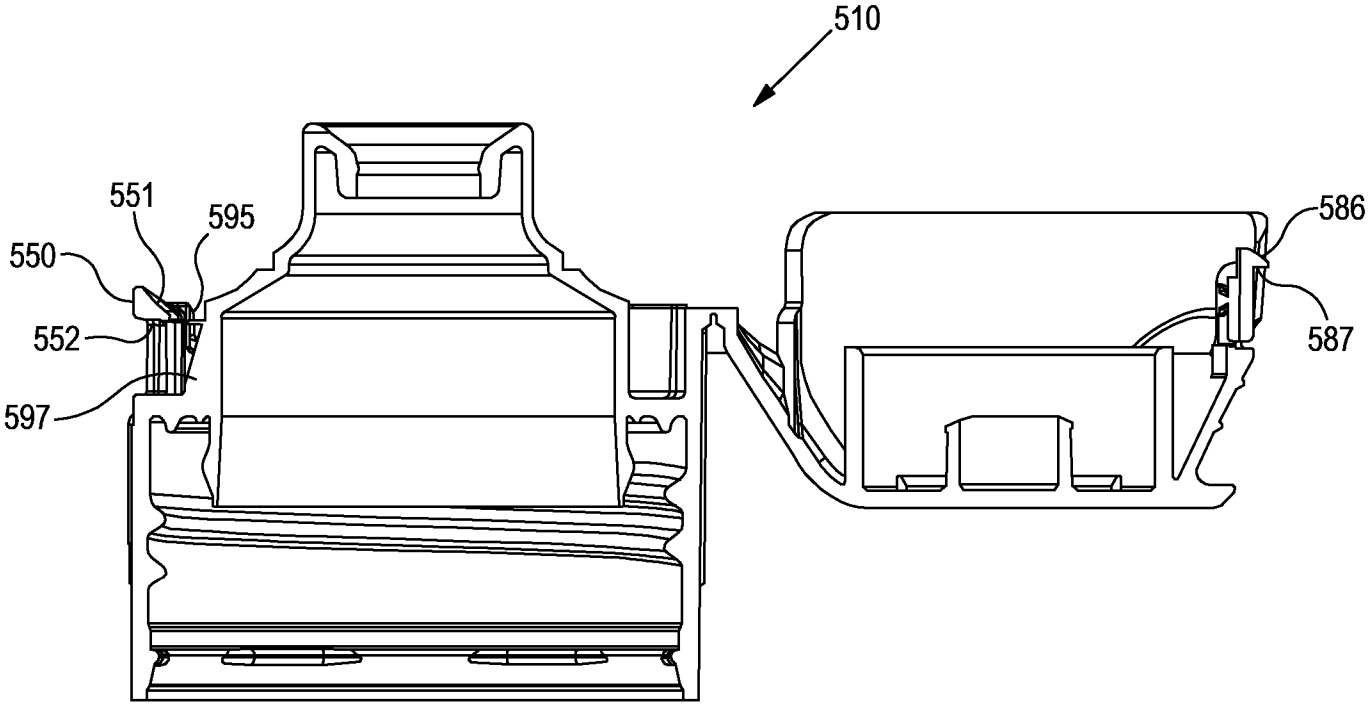
Figure 17:
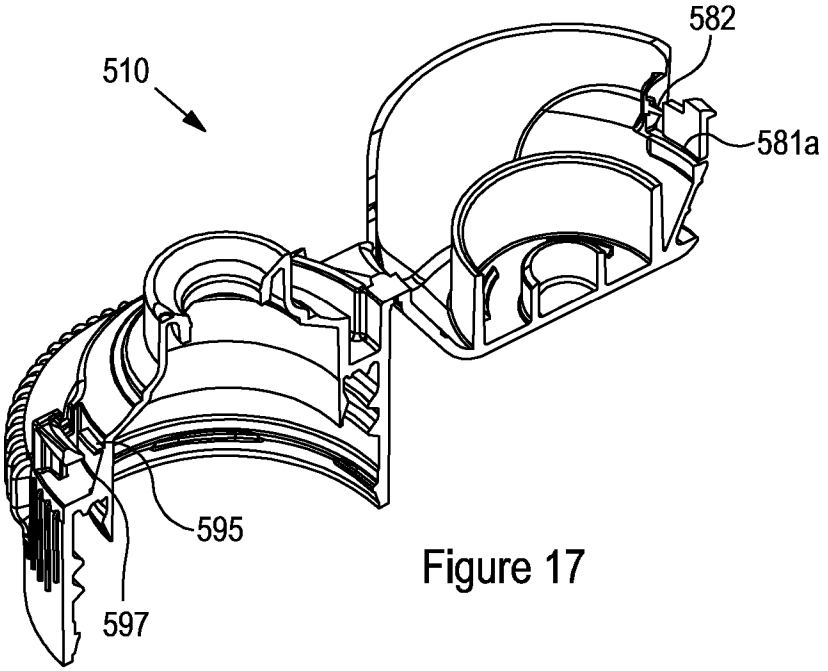
Figure 16:
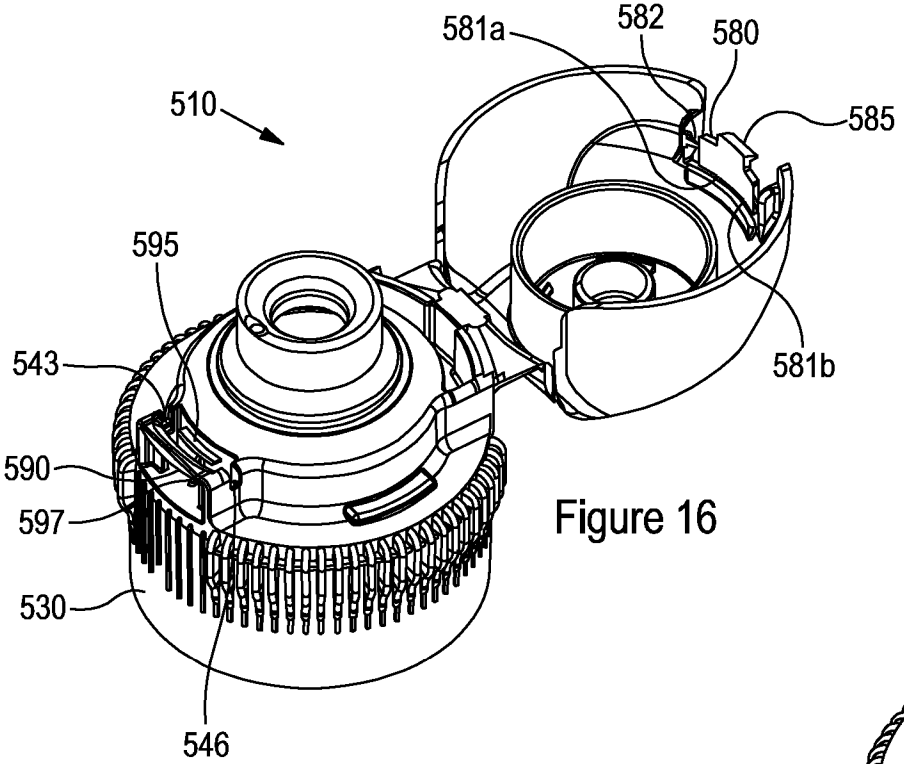

FIGS. 15-17 show the closure in the unclosed condition. It will be noted that the crossbar 550 has a filleted/rounded rear face 551 and a flat bottom face 552. It will also be noted that the tab hook 585 has a rounded bottom face 586 and a flat upper face 587. This means that when the lid is closed for the first time the hook can pass over the crossbar. As the hook passes over the crossbar this will cause deflection and/or deformation of the tab e.g. deflection towards the spout.

Figure 18:
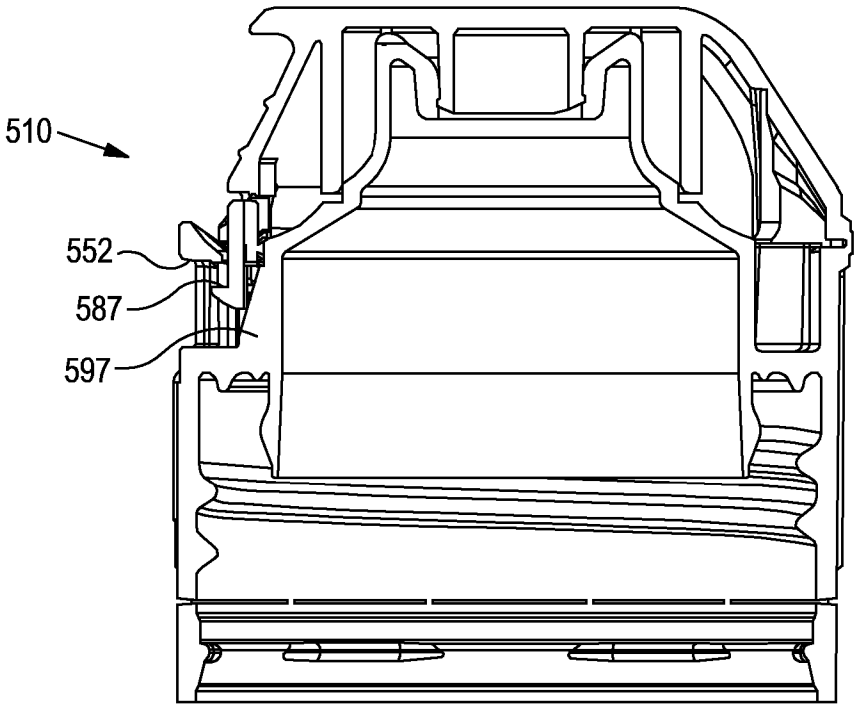
Figure 19:
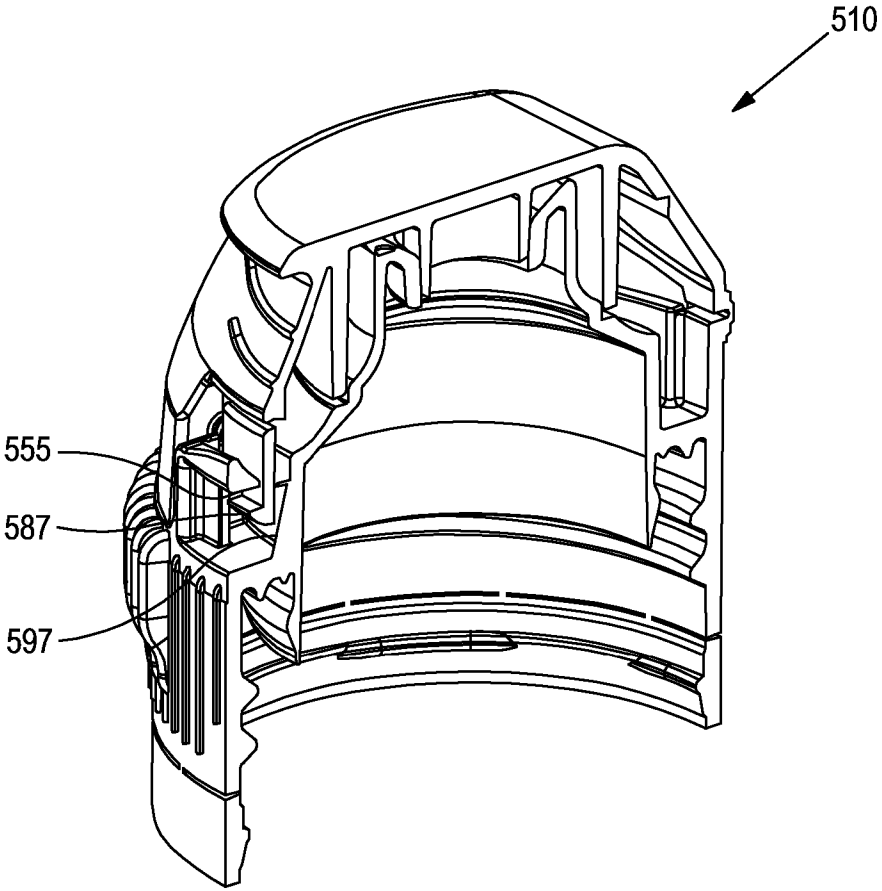
Figure 21:
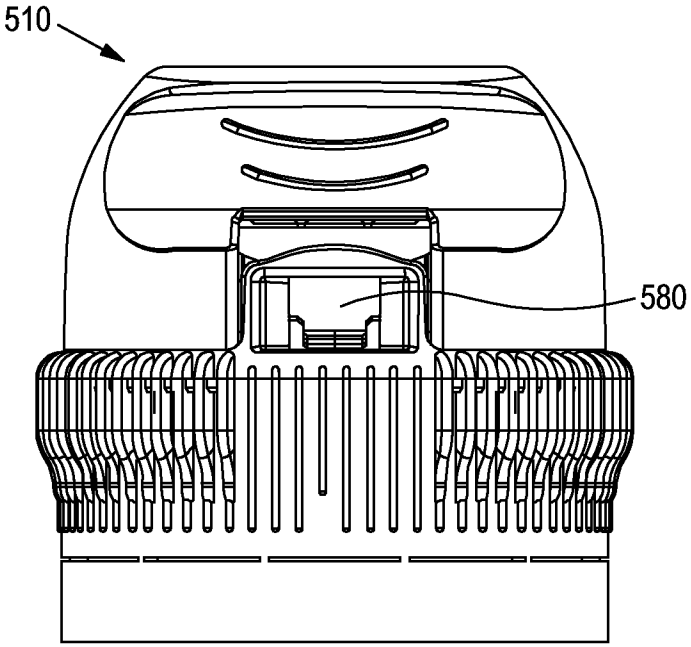
Figure 20:
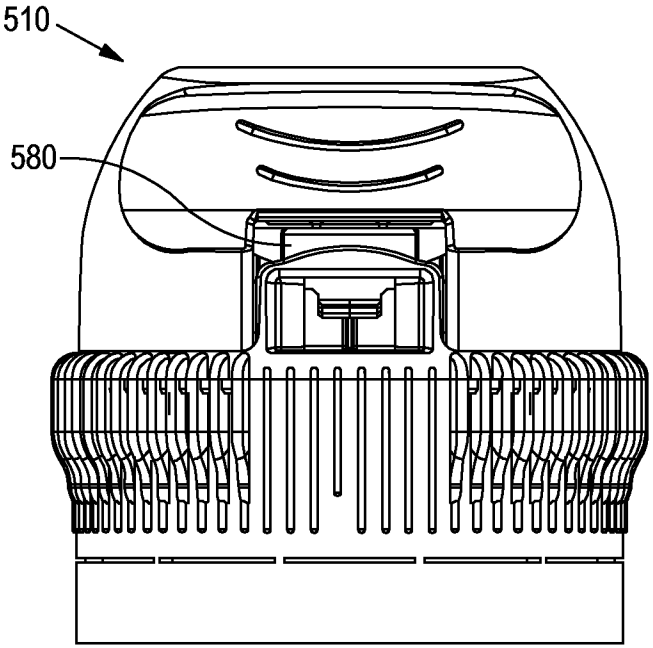
Figure 23:
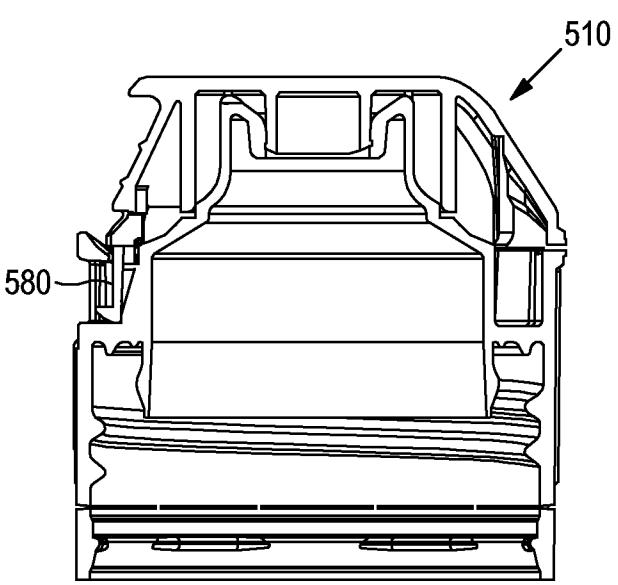
Figure 22:
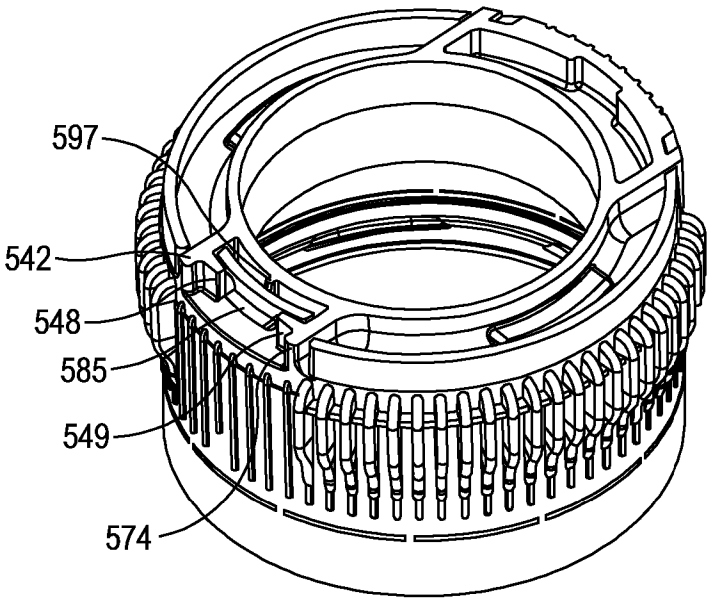
Figure 24:
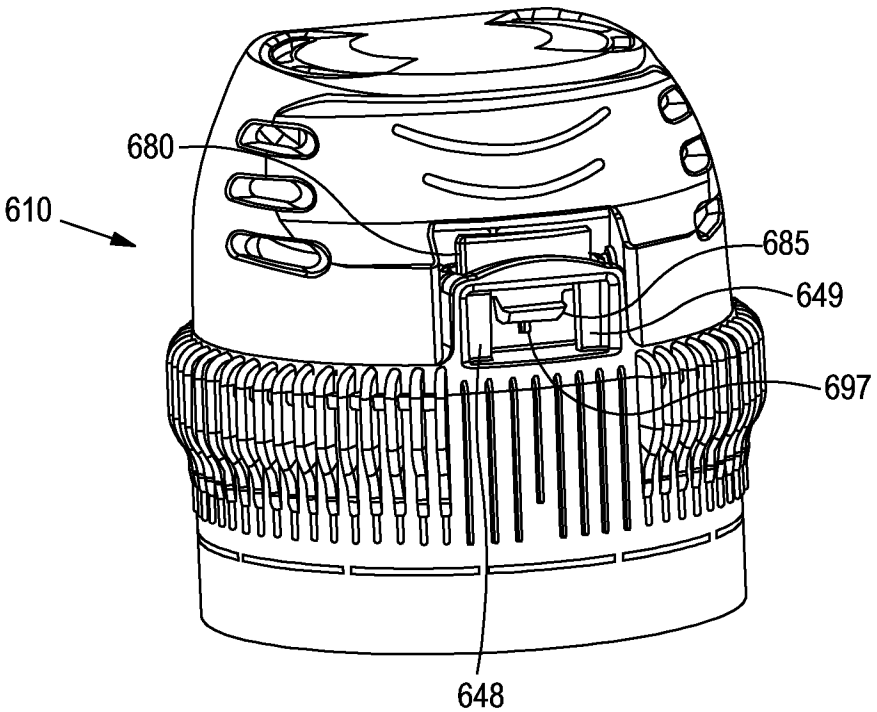
Figure 26:
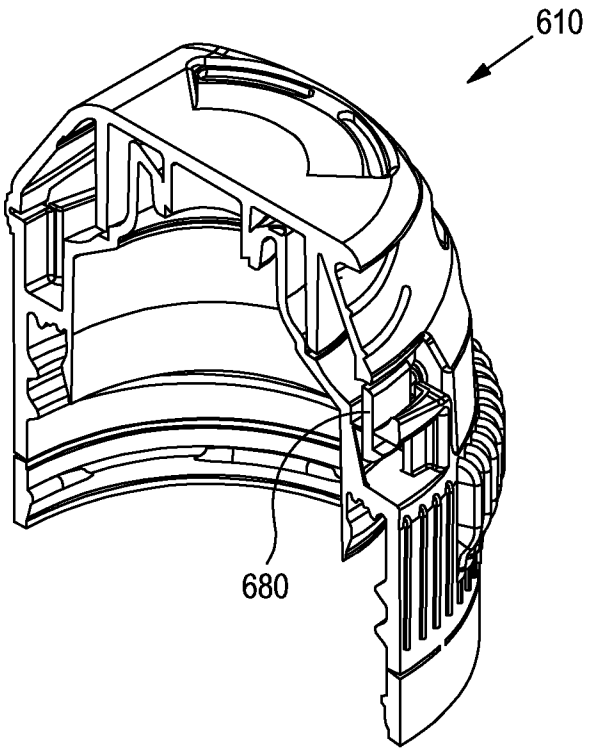
Figure 25:
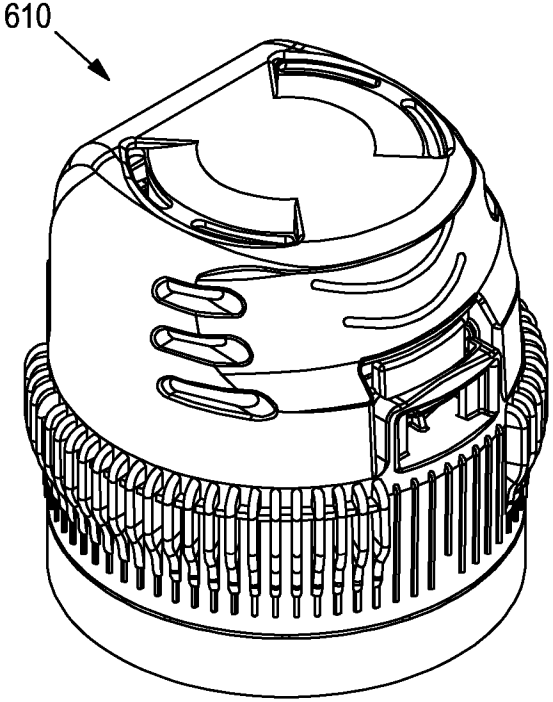
Figure 28:
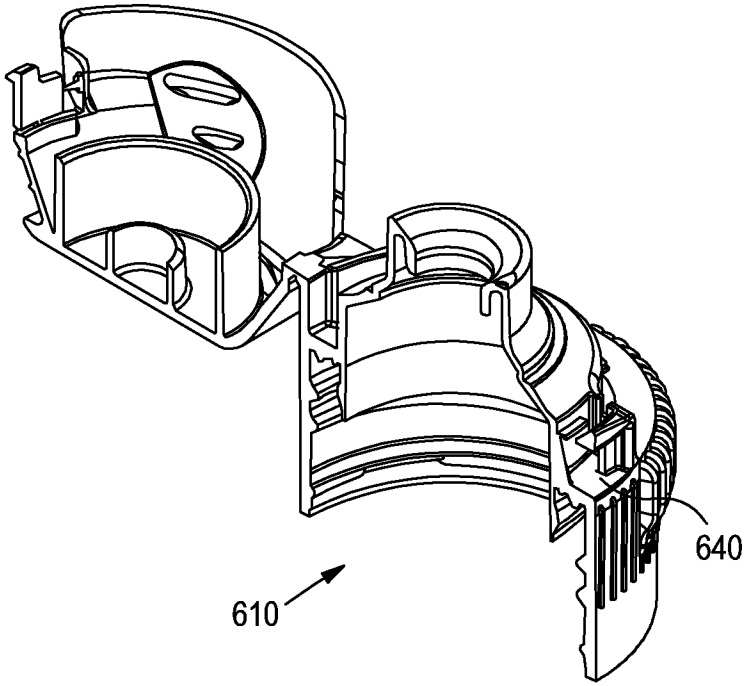
Figure 27:
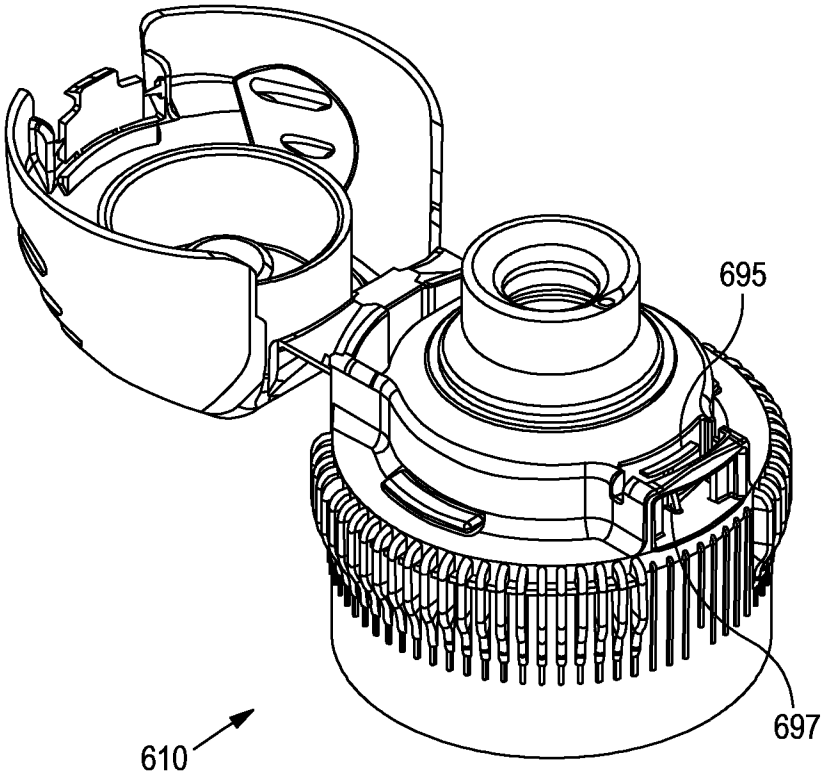
Figure 30:
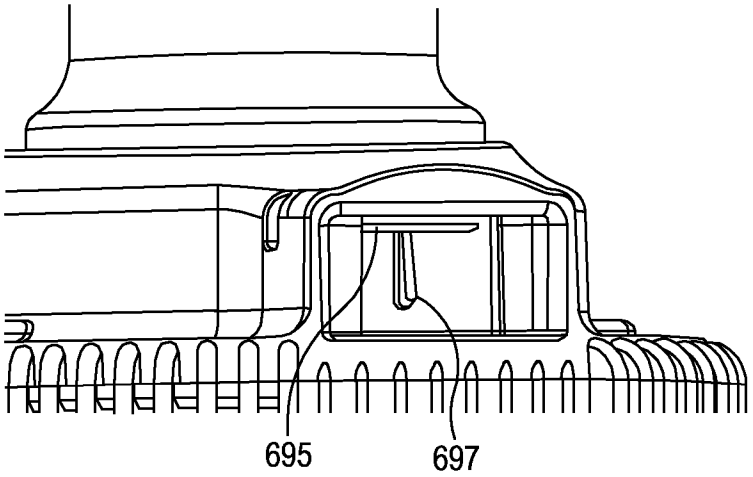
Figure 29:
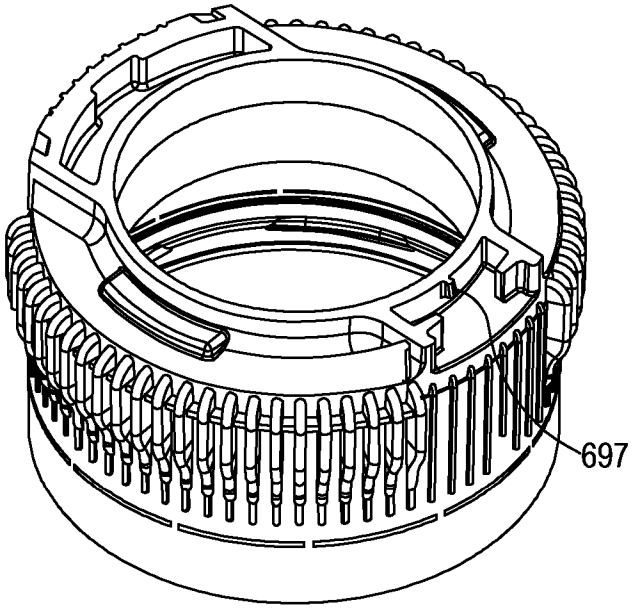

In order for the tamper-evidence of the closure to function it is important that after the hook passes over the crossbar it moves back towards the front of the closure i.e. radially outwards and back under the crossbar so that the hook face 587 is positioned under the crossbar face 552, as shown in FIGS. 18-20. This is required so that when the lid is subsequently lifted the faces 552, 587 abut, causing rupture of the bridges 581*a*, 581*b* (there are two superior frangible bridges in this embodiment), 582, 583 (the lateral bridges) and release of the tab from the cut-out/window 575, as shown in FIGS. 21-23.

In order to help ensure that the hook moves back under the crossbar the front of the spout is provided with a radially outwardly extending rib 595 and an axially extending, generally triangular rib 597 which are arranged in a T-formation.

The rib 595 restricted reward movement/deflection of the tab as the hook passes over the crossbar; then as the lid is further closed the tab slides down the rib 597 (that increases in radial extent towards the top deck) which gently guides the tab forwards. There may also be some resilient provided by the bridges and/or within the tab which would naturally causes forwards movement of the tab.

In this embodiment the lateral supports 542, 544 include nibs 548, 549 which help to define a slot into which the tab falls. The nibs help to prevent the tab from falling out of the closure following first opening.

FIGS. 24 to 30 show a closure 610 formed according to a further embodiment.

The closure 610 is similar to the closure 510 except that the axial rib 697 extends down from the rib 695 but not all the way to the top deck 640 i.e. it is spaced from the top deck.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A single-piece flip-top dispensing closure, the closure comprising a base attachable to a container neck and includes an integral spout, a lid joined by a hinge, and a tamper-evident member is frangibly connected to the lid, the tamper-evident member includes a hook, the base is provided with a raised crossbar under which the hook engages with the closure in an initially closed condition, in which when the lid is initially opened the interaction between the crossbar and the hook causes the tamper-evident member to release from the lid, wherein the tamper-evident member is connected to the lid by a lateral frangible bridge at either side thereof, in which the crossbar is supported by lateral support members, and in which each lateral support member includes a groove in which the lateral frangible bridges sit in the initially closed position.

2. The closure of claim 1, in which following release the tamper-evident member is retained by the base.

3. The closure of claim 2, in which following release the tamper-evident member is visible beneath the crossbar.

4. The closure of claim 1, in which the tamper-evident member and the crossbar are generally opposite the hinge.

5. The closure of claim 1, in which the lateral support members are formed integrally with the spout.

6. The closure of claim 1, in which the tamper-evident member is a tab.

7. The closure of claim 1, in which the base includes a tamper-evident band.

8. The closure of claim 7, in which the band is formed as a tether.

9. The closure of claim 1, in which the base is provided with screw thread formations for engaging cooperating formations on a container neck.

10. The closure of claim 1, in which the base is provided with a snap bead for non-removably engaging a container neck.

11. The closure of claim 1, further comprising means for resisting and/or causing deflection and/or deformation of the tamper-evident member upon first closing of the lid to move the closure into the initially closed condition.

12. The closure of claim 11, in which the means for resisting and/or causing deflection and/or deformation comprises an axial rib.

13. The closure of claim 11, in which the means for resisting and/or causing deflection and/or deformation comprises a horizontal flap.

14. An aseptic closure for a ready-to-drink fruit juice container, comprising the closure of claim 1.

15. The closure of claim 1 in combination with a container.

16. A sportscap comprising a base attachable to a container neck and a lid joined by a hinge, wherein the base includes a top deck and a depending side skirt, the base includes a dispensing spout, wherein the lid further includes a frontal cut-out in which a tamper-evident member is frangibly connected, the tamper-evident member includes a hook, the base is provided with a crossbar which is raised from the top deck and under which the hook engages with the closure in an initially closed condition, in which when the lid is initially opened the interaction between the crossbar and the hook causes the tamper-evident member to release from the lid, and wherein the tamper-evident member is connected to the lid by a lateral frangible bridge at either side thereof, in which the crossbar is supported by lateral support members, and in which each lateral support member includes a groove in which the lateral frangible bridges sit in the initially closed position.

* * * * *